US005106094A

United States Patent [19]

Desbiolles et al.

[11] Patent Number: 5,106,094

[45] Date of Patent: Apr. 21, 1992

[54] GOLF CLUB HEAD AND PROCESS OF MANUFACTURING THEREOF

[75] Inventors: Jacques Desbiolles; Dominique Mermet, both of Annecy, France

[73] Assignee: Salomon S.A., Annecy Cedex, France

[21] Appl. No.: 531,244

[22] Filed: May 31, 1990

[30] Foreign Application Priority Data

Jun. 1, 1989 [FR] France ..... 89 07246

[51] Int. Cl.[5] ..... A63B 53/04

[52] U.S. Cl. ..... 273/167 H; 273/169; 273/173

[58] Field of Search ..... 273/167 R, 167 F, 167 H, 273/167 J, 169, 173, 79

[56] References Cited

U.S. PATENT DOCUMENTS

| | | | |
|---|---|---|---|
| 2,781,197 | 2/1957 | Wiley | 273/164 |
| 3,970,236 | 7/1976 | Rogers | 273/169 X |
| 4,429,879 | 2/1984 | Schmidt | 273/167 H |
| 4,438,931 | 3/1984 | Motomiya | 273/167 H |
| 4,545,580 | 10/1985 | Tomita et al. | 273/167 R |
| 4,614,627 | 9/1986 | Curtis et al. | 273/167 H X |
| 4,618,149 | 10/1986 | Maxel | 273/79 |
| 4,824,110 | 4/1989 | Kobayashi | 273/169 X |

FOREIGN PATENT DOCUMENTS

| | | |
|---|---|---|
| 211781 | 11/1960 | Austria . |
| 2550457 | 2/1985 | France . |
| 267755 | 3/1927 | United Kingdom . |
| 2184951 | 7/1987 | United Kingdom . |

OTHER PUBLICATIONS

French Search Report and Annex.

*Primary Examiner*—William H. Grieb

*Attorney, Agent, or Firm*—Sandler, Greenblum, & Bernstein

[57] ABSTRACT

A golf club head, and a process of manufacturing a golf club head, in which the golf club head includes a body having an interior space, a cover plate for attachment to the body, the cover plate having a surface forming a golf ball striking surface, and a quantity of material within at least a portion of the interior space, for assisting in securing the cover plate to the body. The quantity of material can be a filler material which is injected or poured, prior to installing the shaft on the club head, through sleeve which communicates with the interior space of the body of the head. Further, the golf club head may also include an internal transverse surface which can be defined, for example, by a separate partition which divides the interior space of the hollow body, so as to reduce the quantity of the filler material, and a member to hold the cover plate in place prior to the introduction of the filler material into the hollow body, for example, a member which is compressed between the internal transverse surface and the cover plate.

25 Claims, 5 Drawing Sheets

GOLF CLUB HEAD AND PROCESS OF MANUFACTURING THEREOF

BACKGROUND OF THE INVENTION

1. Field of the Invention

The present invention relates to a golf club head and, more particularly, to the golf ball-striking face of a golf club head, as well as to a process of manufacturing the golf club head.

2. Description of Background and Other Information

In known golf club heads, the golf ball striking face is composed of a plate, which is generally made of metal and is secured either to a hollow or to a solid body made of wood or of a synthetic material. The metal plate is most often secured to the body by screws, but it may also be glued or welded thereto.

For example, British Patent No. 267,755, Austrian Patent No. 211,781, U.S. Pat. No. 4,618,149, and British Patent No. 2,184,951 disclose composite golf club heads, that is, club heads wherein the striking face is made of a material which is different from that of the remainder of the head.

However, known methods of assembling golf club heads are not always satisfactory from the standpoint of service life, especially considering the intense mechanical stresses and environmental factors to which the club heads are exposed, such as temperature variations, ultraviolet radiation, potential contact with herbicides, etc., particularly if the body is made of a synthetic material.

Furthermore, in the case of a unit assembled with screws, the need to pre-drill and to pre-thread holes in the body of the head complicates the manufacturing process and restricts the potential maximum production rates.

SUMMARY OF THE INVENTION

It is therefore an object of the present invention to provide a golf club head including:

(a) a body having an interior space;

(b) a cover plate for attachment to the body, the cover plate having a surface forming a golf ball striking surface; and (c) means for securing the cover plate to the body, including a quantity of material within at least a portion of the interior space.

More specifically, according to the invention, the quantity of material is a unitary mass of material.

Further, the body includes an opening communicating with the interior space and defined by a periphery and means on the periphery for positioning the cover plate relative to the body.

According to one embodiment, the means for positioning the cover plate includes a continuous peripheral shoulder.

According to a second embodiment, the means for positioning the cover plate includes a plurality of peripheral flanges.

In a further embodiment of the invention, the body includes an opening defined by a first periphery, the first periphery including a first tapered surface facing the interior space, and the cover plate includes a second periphery, the second periphery including a second tapered surface which mates with the first tapered surface when the cover plate is secured to the body.

In a particular form of the invention, a transverse surface is positioned within the interior space, the quantity of material being positioned between the transverse surface and the cover plate.

According to a particular embodiment of the invention, the transverse surface is defined by a partition positioned within the interior space.

More specifically according to the aforementioned embodiment of the invention, the body includes a first section and a second section, and the first section and the second section are positioned on opposite sides of the partition.

In an alternative embodiment of the invention, the quantity of material includes a first quantity of material occupying a portion of the interior space, and the transverse surface includes an exposed area of the first quantity of material within the portion of the interior space.

According to a further aspect of the invention, means are provided for holding the cover plate in a predetermined position prior to introducing the quantity of material within the interior space.

More specifically, the means for holding the cover plate includes an elastic means for pressing the cover plate against the periphery of the body.

According to a still further aspect of the invention, means are provided for centering the cover plate relative to the periphery of the body.

According to a still further aspect of the invention, means are provided which extend from the cover plate for anchoring the cover plate to the quantity of material.

In a more specific feature of the invention, a hollow sleeve is affixed to the body and communicates with the interior space for receiving the quantity of material and for receiving a shaft for a golf club included of the golf club head and the shaft.

According to another aspect of the invention, the quantity of material within the interior space is selected from the group consisting of polyamides, polyesters, polyethylenes and composites of any of the foregoing.

According to an additional aspect of the invention, the quantity or material is at least partially formed of an elastomer.

Further according to the invention, the body is comprised of a material different from a material of which the cover plate is comprised.

The process of the invention can be defined as including the steps of:

(a) positioning the cover plate relative to the body; and (b) securing the cover plate to the body including introducing a quantity of material into the interior space of the body.

Further according to the method of the invention, the step of introducing a quantity of material into the interior space of the body includes pouring a quantity of pourable material into the interior space.

Still further, the step of introducing a quantity of material into the interior space of the body presses the cover plate against the periphery.

Still further, the process includes, prior to the step of introducing a quantity of material into the interior space of the body, the step of installing a partition within the interior space of the body, and wherein the step of introducing a quantity of material into the interior space of the body includes introducing a quantity of material between the partition and the cover plate.

Additionally, prior to the step of introducing a quantity of material into the interior space of the body, the process further includes introducing a first quantity of material into a portion of the interior space, thereby forming an exposed area of the first quantity of material, and wherein the step of introducing a quantity of material into the interior space of the body includes introducing a quantity of material between the exposed area of the first quantity of material and the cover plate.

The process of the invention further includes, prior to the step of introducing a quantity of material into the interior space of the body, the step of installing a means for holding the cover plate in a predetermined position relative to the body.

Still further, the step of introducing a quantity of material into the interior space includes the step of introducing the quantity of material through the sleeve to the interior space.

A golf club is assembled by the combination of the process of manufacturing a golf club head and the step of attaching a shaft to the golf club head, and preferably, by attaching the shaft into the sleeve.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
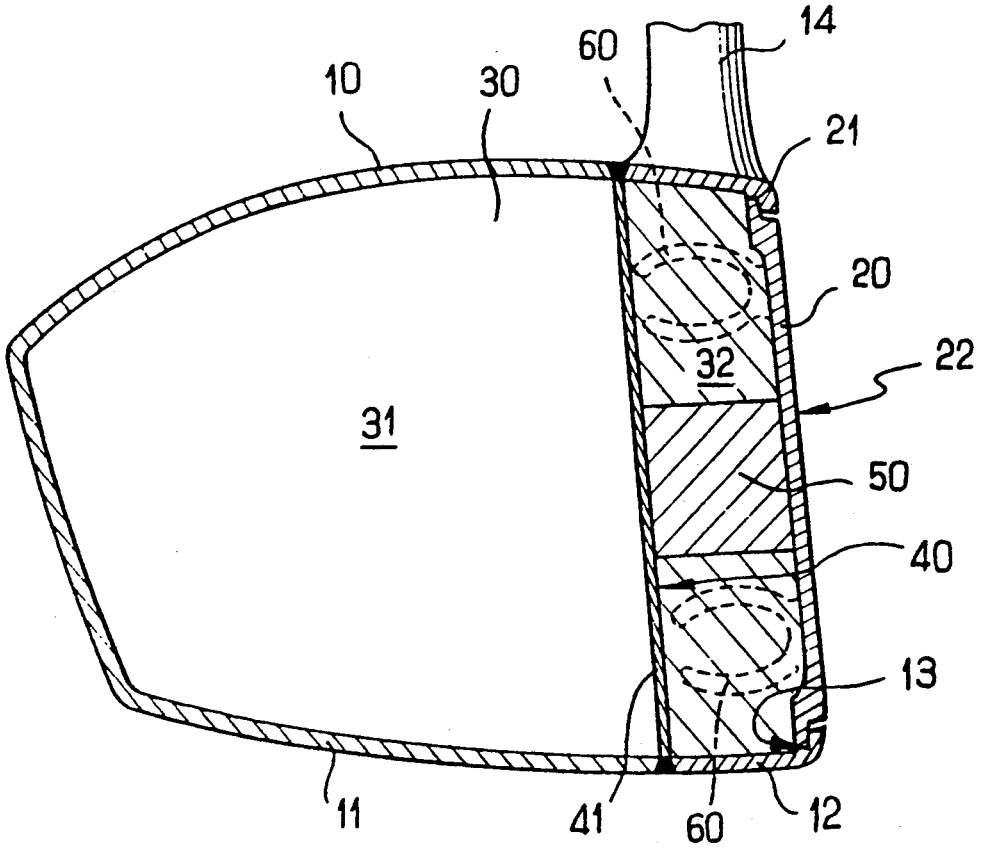
FIG. 1 is a cross-sectional view of a golf club head according to the invention.

The present invention has, as an objective, to provide a composite golf club head, the structure of which obviates the need to resort to screws or adhesives to secure the striking face to the body. The golf club head of the present invention provides an assembly with a very long service life. Further, the production of the golf club head of the present invention may easily be automated for large-scale industrial manufacturing.

To this end, the golf club head of the present invention includes a hollow body, made of a first material, which defines an open interior space. A cover plate is positioned to cover the interior space of the body. The cover plate is made of a second material, which is different from the first, and its outside surface forms the striking face of the club. Further, a filler material is provided to fill at least part of the interior space of the body and to assist in securing the cover plate to the body.

According to a number of advantageous aspects of the present invention:

the cover plate cooperates with the body by being positioned against a stop outwardly against continuous or discontinuous peripheral supporting means provided on the body;

an internal transverse surface is provided which divides the interior space of the hollow body to reduce the volume of the filler material therein and, more particularly, this internal transverse surface may be constituted by a separate partition, or by the exposed area of a material previously introduced into the hollow body to partially fill it, wherein, in the former embodiment, the body may be formed of two body sections which are assembled on either side of the separate partition which defines the internal transverse surface;

means are provided for holding the cover plate in place prior to introducing the filler material into the hollow body, wherein the holding means may be elastic means for compressing the cover plate against the peripheral support of the body and, more particularly, the holding means may be elastic means which are compressed between the internal transverse surface and the inside face of the cover plate;

means are provided for laterally centering the cover plate relative to the periphery of the opening of the hollow body;

the inside face of the cover plate is equipped with means for securing it to the mass of filler material;

the interior space of the body communicates with a lateral hollow sleeve through which the filler material is introduced prior to installing the shaft on the club head;

the filler material is selected from the group comprising polyamides, polyesters, polyethylenes and combinations thereof, and/or it is at least partially composed of an elastomer; and the filler material is at least partially composed of an elastomer.

A further object of the invention is to provide a manufacturing process for a golf club head, comprising the steps of producing a hollow, open body; closing the hollow body with a cover plate which has an outside surface which forms the striking face of the club; and introducing, within at least part of the interior space of the body, a filler material which helps to secure the cover plate to the body. The constituent materials of the hollow body and the cover plate may be identical, but, preferably, are different.

Very advantageously, the quantity and pressure of the filler material are selected such that the cover plate is compressed against the continuous or discontinuous peripheral support provided on the body.

Preferably, the process also comprises the following steps:

installing, prior to the introduction of the filler material, a separate partition defining an internal transverse surface which divides the interior space of the hollow body so as to reduce the volume of filler material therein;

partially filling the hollow body prior to introducing the filler material, so as to reduce the amount of filler material subsequently introduced therein; and/or prior to closing the hollow body by means of the cover plate, or simultaneously with this operation, holding the cover plate in place.

Exemplary embodiments of the invention will now be described with reference to the drawings.

In FIG. 1, a cross-section of a golf club head according to the invention is illustrated. As shown therein, the body 10 of the club head is composed of two body sections 11 and 12, defining an interior space 30 which is open at the front (the front part being the part, shown at the right of the figure, of the side on which the golf club head will strike the ball).

The interior space 30 is sealed by a cover plate 20, the edge 21, or flanges affixed to the edge, which is positioned toward the outside of the space 30 against an interior shoulder 13 of a rim which extends around the opening of space 30 of the body 10. The exterior surface 22 of the cover plate forms the striking face of the club, and it is shaped in a known manner, that is, it is very slightly convex and ridged, as is apparent, for example, in the front views of FIGS. 9, 12 and 18.

The interior space 30 of the body 10 is partially or completely filled with a hardening material which is injected or poured inside the body.

In the example of FIG. 1, the filler material does not fill the entire volume of the interior space 30, thereby providing for the use of a reduced volume of this material. This is achieved by defining an internal transverse surface 40, for example, but not necessarily, as will be explained below, by means of a separate transverse partition 41 assembled between the two body sections 11 and 12. The space 31 situated behind this partition (that is, on the side opposite the cover plate 20) remains empty, while the space 32 situated on the other side receives the filler material.

Very advantageously, the filler material is injected or poured through the hollow sleeve 14 which, once the club head has been made, receives the club shaft. The hollow sleeve 14, which is preferably unitarily formed with the body section 12, communicates with the enclosed interior space 32 defined by the transverse partition 41, the cover plate 20 and the body section 12. The filler material is poured or injected within this enclosed space.

The primary role of the filler material which is injected or poured within the space 32, i.e., behind the cover plate 20, after the filler material hardens, is to hold in place and to secure the body 10 to the cover plate 20, thus providing an assembly of these two components which does not require screws, adhesives or welding, and, furthermore, the assembly is easy to produce and provides a very long service life.

In order to hold the cover plate 20 in place during the pouring and hardening of the filler material, an elastic member 50 is provided which is constituted, for example, by a block of elastomer, which is compressed between the partition 41 and the cover plate 20, and which compresses the striking face 22 against the shoulder 13 of the body 10.

However, this manner of holding the cover plate is not indispensable, and the cover plate 20 may, alternatively, be held in place against the interior shoulder 13 of the body 10 simply by gravity while the material is hardening, wherein filling and hardening are then conducted with the striking face 22 oriented downwardly.

Furthermore, the quantity and the pressure of the filler material may be selected such that the pressure developed in the space 32 during injection compresses the cover plate 20 against the shoulder 13. The filler material may also be an expansible material (and particularly, a material comprising an elastomer component) such that an internal pressure develops within the cavity 32 during polymerization of the material.

Among the materials which may be used to fill the cavity 32, the material more specifically is preferably selected from the group consisting of polyamides, polyesters, polyethylenes and composites thereof.

Among the polyamides, the following are more particularly envisioned: PEBAX®, GRILAMID® and VESTAMID® (polyamide elastomers): among the polyesters, ARNITEL® and HYTREL® (polyether esters); and among the polyethylenes, SURLYN® (acrylic polyethylene).

Advantageously, the cover plate 20 may also be equipped with projections 60 for anchoring it to the mass of the filler material, for example, projections in the form of prongs, as illustrated in FIG. 1. The extremities of these prongs may abut against the partition 41 (or against the bottom of the body, in the absence of such a partition).

If the anchor prongs 60 are made of an elastic material and abut the partition or the bottom, they may advantageously serve to complement or to substitute for the holding function performed by the intercalary component 50. These prongs may be formed from a non-elastic material, however, such as a ceramic material, for example.

FIGS. 2 to 8 illustrate the different stages of one of the possible processes for constructing the club head of FIG. 1.

Figure 2:
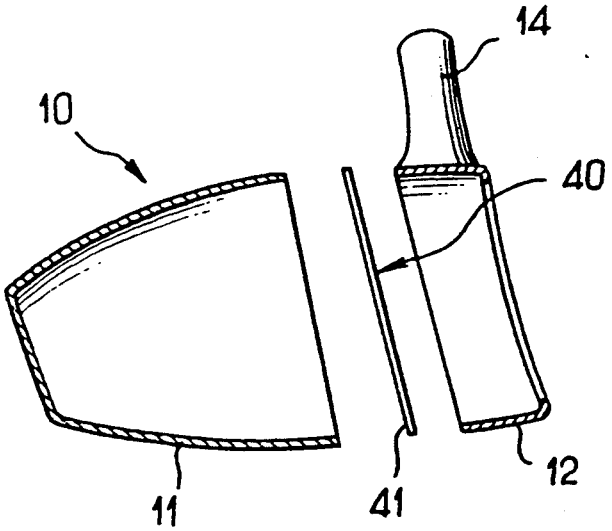
FIGS. 2 to 8 show details of the various stages of a process of manufacturing the golf club head of FIG. 1.

First, as depicted in FIG. 2, the body 10 is assembled by joining the body sections 11 and 12, while interposing the partition 41 therebetween, which defines the internal transverse surface 40.

Figure 3:
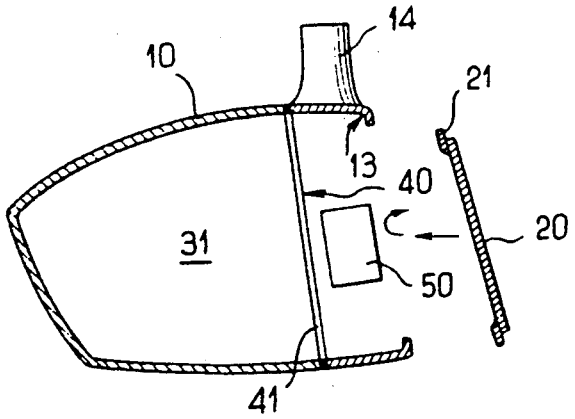
Figure 4:
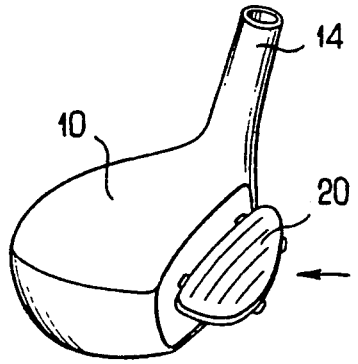

Second, as depicted in FIGS. 3 and 4, the intercalary elastic plug 50 is placed against the partition 41 and the cover plate 20 is inserted in the cavity against the shoulders 13 of the body, by tilting the cover plate at a slight angle, wherein face 22 of the cover plate 20 is turned toward the outside of the cavity.

Figure 5:
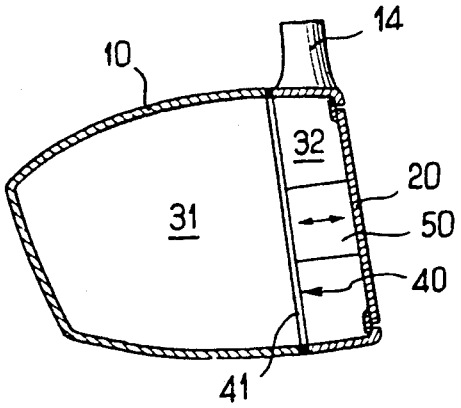
Figure 6:
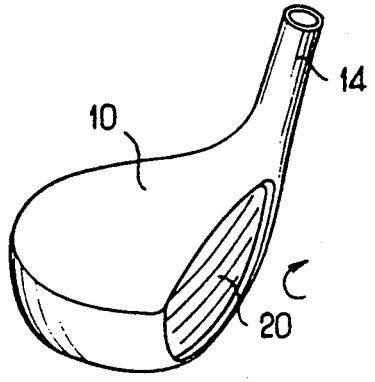

Once the cover plate 20 has been fully inserted into the body 10, it is straightened such that it returns to its normal position, as shown in FIGS. 5 and 6, that is, with its edge 21 abutted against the shoulder 13 and its face 22 facing outwardly. The cover plate 20 is temporarily held in this position, which is its permanent position, by the intercalary elastic plug 50, which is compressed between the partition 41 and the cover plate 20, in this example.

Figure 7:
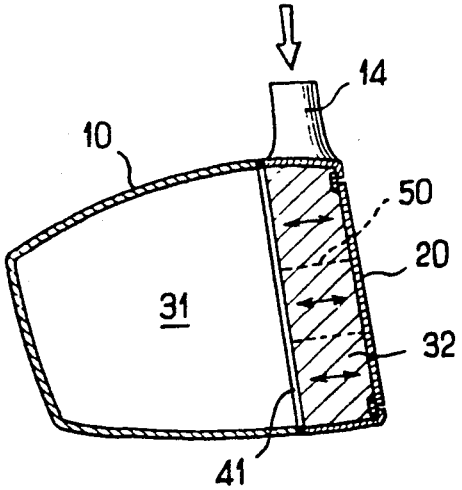
Figure 8:
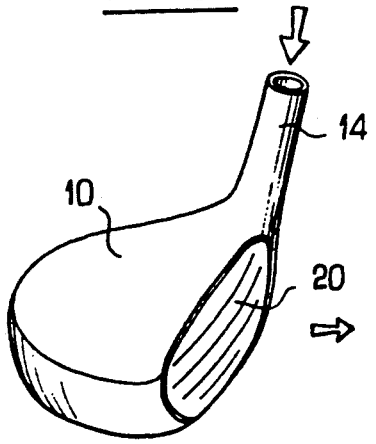

It is then possible, as illustrated in FIGS. 7 and 8, to pour or to inject the filler material through the sleeve 14 which, as indicated above, communicates directly with the cavity 32 defined within the body 10. The filler material thus injected or poured will, after it has hardened, lock the cover plate 20 into place, thereby ensuring a permanent bond with the body 10.

Figure 9:
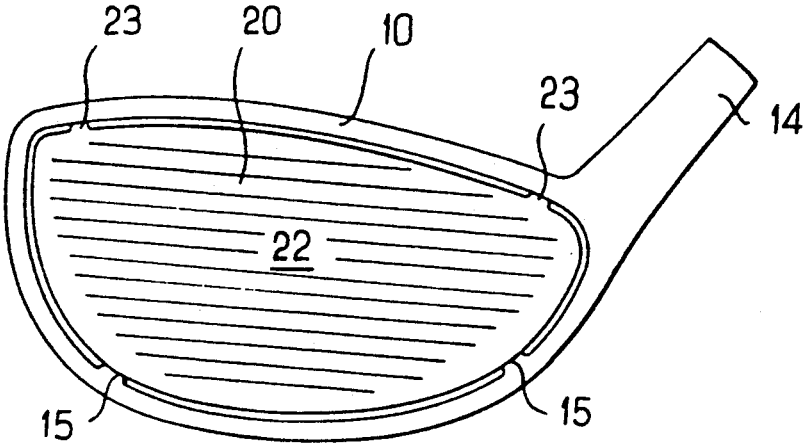
FIG. 9 is a front elevation view of a golf club head according to the invention, illustrating the manner in which the striking face is laterally centered.

FIG. 9 illustrates means which additionally provide for the lateral centering of the striking face 22 relative to the body 10. This centering is provided by appropriate flanges formed on the inside periphery of the rim of the opening of the body 10 (flange 15) and/or on the outside periphery of the cover plate 20 (flange 23).

Figure 10:
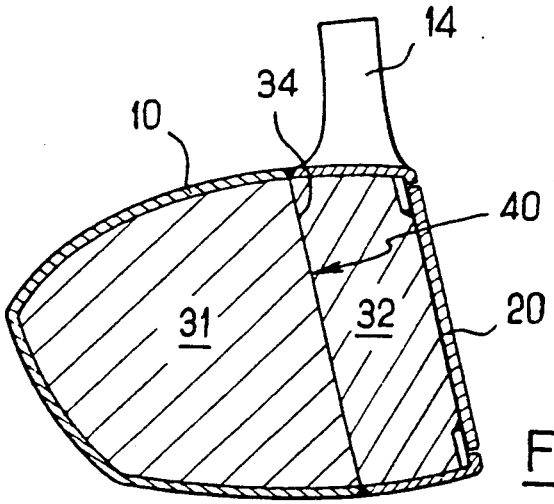
FIG. 10 illustrates a second embodiment of the golf club head of the invention.

FIG. 10 illustrates a variation of the process, wherein the internal transverse surface 40 is not defined by a separate partition, but by the exposed area 34 of a filling material 31 which is poured in the bottom of the body 10, during which the body 10 is positioned such that its open end is turned upwardly. This provides for limiting the volume of the filler material, as such, which is introduced in the remaining space 32, in the same manner as in the case wherein the transverse surface 40 was defined by a separate partition 41.

Figure 11:
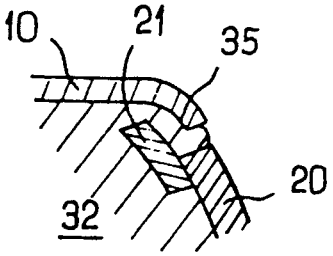
FIGS. 11 and 12 illustrate the manner in which a continuous seal is produced between the body and the striking face during the manufacturing process.
Figure 12:
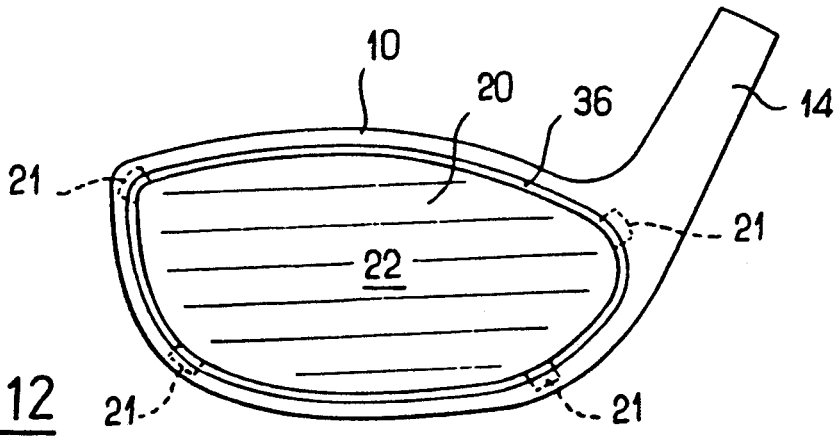

FIGS. 11 and 12 illustrate a detail of the embodiment wherein a gap 35 is allowed to remain, in the transverse direction, between the interior periphery of the opening of the body 10 and the exterior periphery of the cover plate 20. By injecting the filler material in the cavity 32 under pressure, the material will penetrate into this gap 35, thereby creating a continuous peripheral seal 36 between the body 10 and the cover plate 20, around the striking face 22, as illustrated in FIG. 12. If necessary for this purpose, the edge supports 21 can be appropriately shaped to contact shoulders 13 of body 10, but to space the peripheral edge of the cover plate 20 away from the peripheral edge of the body to define the gap 35.

FIGS. 13 to 17 illustrate several variations of the manner by which the supports 21 on the edges of the cover plate enable the cover plate 20 to abut against the shoulder 13 of the body 10.

Figure 13:
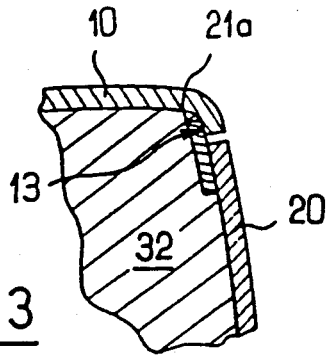
FIGS. 13 and 14 illustrate a first embodiment of the peripheral support for the striking face on the body.
Figure 14:
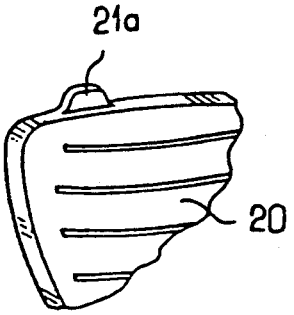

In FIGS. 13 and 14, the supports are composed of lateral projections 21*a*, which extend outwardly from the cover plate 20. These projections 21*a* may be formed unitarily with the remainder of the cover plate 20, or they may be formed by tabs added thereto.

Figure 15:
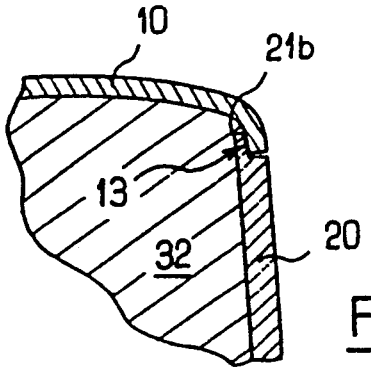
FIGS. 15 and 16 illustrate a second embodiment of the means of supporting the striking face against the body.
Figure 16:
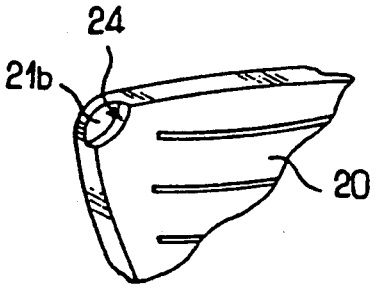

In FIGS. 15 and 16, the supports are composed of recessed areas 21*b* formed in the thickness of the cover plate.

In either case, i.e., whether projections or recessed areas, there may be either a plurality of supports distributed around the periphery of the cover plate, as shown in the various figures, or a continuous peripheral support. However, only a plurality of isolated supports provide for a peripheral seal 36 as shown in FIGS. 11 and 12.

Figure 17:
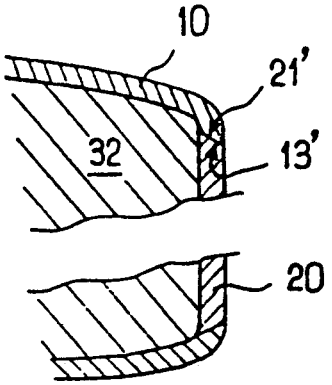
FIG. 17 illustrates a third embodiment of the means of supporting the striking face against the body.

There may also be provided, as illustrated in FIG. 17, a tapered fit between the body 10 and the cover plate 20. The mating contact surfaces 13', 21' represent the cooperating tapered surfaces. Depending upon the embodiment, it is also possible to provide a locking fit, by force-fitting the cover plate 20 in the opening of the body 10, as well as, alternatively, a non-locking fit.

Figure 18:
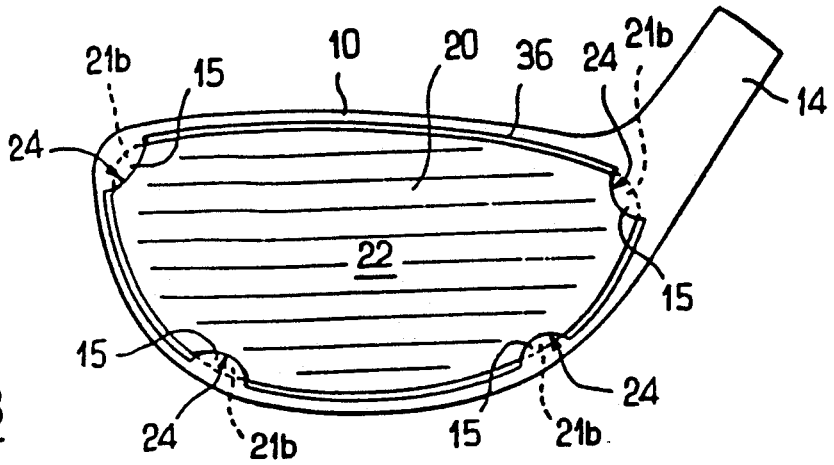
FIG. 18 is a front elevation view showing an alternative embodiment which provides for combining the means of supporting the striking face against the body and the relative lateral centering of these two components.
Figure 19:
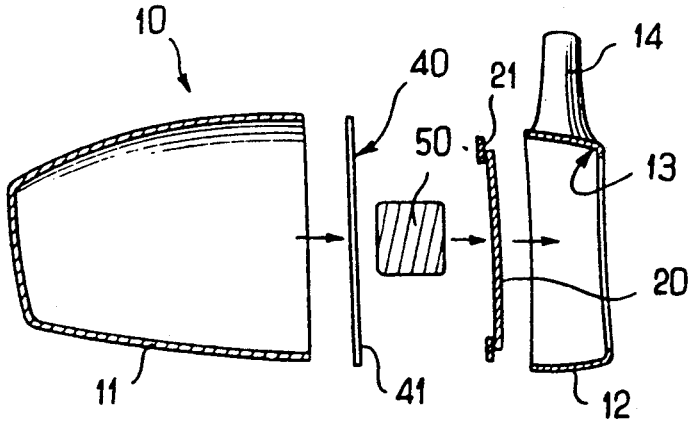
FIGS. 19 to 22 illustrate a variation in the assembly process of the golf club head of the invention.
Figure 20:
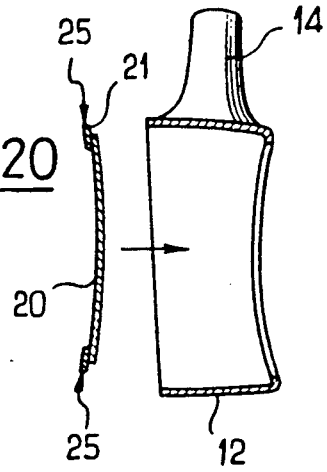
Figure 21:
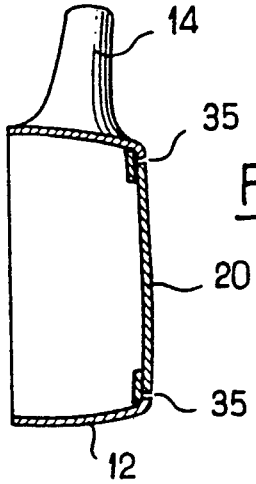

FIG. 18 illustrates an embodiment wherein the same components serve as both stopping means and means for centering the striking face 22 relative to the body 10. For this purpose, the supporting components are components such as those illustrated in FIG. 16, that is, they are formed by removing material from the thickness of the cover plate 20, and they come to abut against the projections 15 of the body which extend transversely toward the inside, in the manner of the projections 15 of FIG. 9, which, in turn, fit against the mating surface 24, as shown in FIG. 16, of the segment of the recessed part forming the supporting flange 21*b*.

FIGS. 19 to 22 illustrate a variation of the process for the embodiment of the club head of the invention.

In this variation, the first step is to mount the cover plate 20 in the front body section 12. Thereafter, the remainder of the head is assembled by installing the elastic plug 50, locking it in place by mounting the interior partition 41, and then enclosing the assembly by installing the rear body section 11.

In this variation, it is also possible to eliminate the intercalary elastic component 50 by force-fitting the cover plate 20 in the front body section, which obviates the need to temporarily hold the cover plate in place in the body by means of the elastic component 50.

In particular, it is possible that this force-fitting can be performed in the area of the outside edge 25 of the supports 21, wherein the overall dimensions of the cover plate are selected such that they are slightly larger than the inside dimensions of the opening of body section 12. Such force-fitting, with tightening in the area of the supports, which thereby also provides for lateral centering, allows for retention of the gap 35, which will be used to make the continuous peripheral seal, once it is filled with the filler material.

Figure 22:
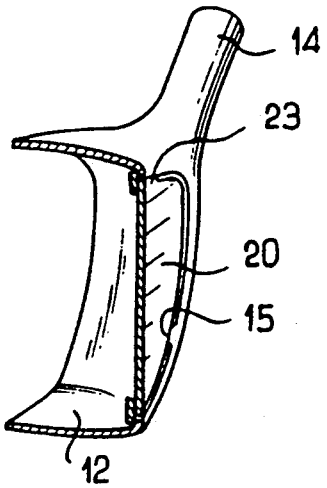

As a variation or as an addition, centering may also be achieved, as shown in the perspective cross-sectional view of FIG. 22, by flanges 15, 23 which are formed, respectively, on the body and/or on the cover plate, in the manner shown in FIG. 9.

The disclosed technique of the invention is applicable to embodiments of all types of golf clubs, that is, for woods as well as for irons.

Finally, although the invention has been described with reference of particular means, materials and embodiments, it is to be understood that the invention is not limited to the particulars disclosed and extends to all equivalents within the scope of the claims.

What is claimed is:

1. A golf club head comprising:
(a) a body having an interior space;
(b) a cover plate for attachment to said body, said cover plate being a separate member from said body and having a surface forming a golf ball striking surface; and
(c) means for securing said cover plate to said body, comprising a quantity of filler material within at least a portion of said interior space for pressing said cover plate against said body.

2. The golf club head of claim 1, wherein said quantity of material is a unitary mass of material.

3. The golf club head of claim 1, wherein said body comprises an opening communicating with said interior space and defined by a periphery and means on said periphery for positioning said cover plate relative to said body.

4. The golf club head of claim 3, further comprising means for holding said cover plate in a predetermined position prior to introducing said quantity of material within said interior space.

5. The golf club head of claim 4, wherein said means for holding said cover plate comprises an elastic means for pressing said cover plate against said periphery of said body.

6. The golf club head of claim 3, further comprising means for centering said cover plate relative to said periphery of said body.

7. The golf club head of claim 1, wherein said means for positioning said cover plate comprises a continuous peripheral shoulder.

8. The golf club head of claim 1, wherein said means for positioning said cover plate comprises a plurality of peripheral flanges.

9. The golf club head of claim 1, further comprising means for holding said cover plate in a predetermined position prior to introducing said quantity of material within said interior space.

10. The golf club head of claim 1, further comprising means extending from said cover plate for anchoring said cover plate to said quantity of material.

11. The golf club head of claim 1, further comprising a hollow sleeve affixed to said body and communicating with said interior space receiving said quantity of material and for receiving a shaft for a golf club comprised of said golf club head and said shaft.

12. The golf club head of claim 1, wherein said quantity of material is selected from the group consisting of polyamides, polyesters, polyethylenes and composites of any of the foregoing.

13. The golf club head of claim 1, wherein said quantity of material is at least partially formed of an elastomer.

14. The golf club head of claim 1, wherein said body is comprised of a material different from a material of which said cover plate is comprised.

15. The golf club comprising, in combination, the golf club head of claim 1, and a shaft attached to said body of said golf club head.

16. A golf club head comprising:

(a) a body having an interior space;

(b) a cover plate for attachment to said body, said cover plate having a surface forming a golf ball striking surface;

(c) means for securing said cover plate to said body, comprising a quantity of material within at least a portion of said interior space; and (d) an interior surface positioned within said interior space, spaced from said cover plate, wherein said quantity of material is positioned between said interior surface and said cover plate.

17. The golf club head of claim 16, wherein said interior surface is defined by a partition positioned within said interior space.

18. The golf club head of claim 17, wherein said body comprises a first section and a second section, and wherein said first section and said second section are positioned on opposite sides of said partition.

19. The golf club head of claim 16, wherein said quantity of material includes a first quantity of material occupying a portion of said interior space, and wherein said interior surface comprises an exposed area of said first quantity of material within said portion of said interior space.

20. The golf club head of claim 16, further comprising means for holding said cover plate in a predetermined position prior to introducing said quantity of material within said interior space.

21. The golf club head of claim 20, wherein said means for holding said cover plate comprises an elastic means positioned between said interior surface and an interior surface of said cover plate for pressing said cover plate against said periphery of said body.

22. The golf club head of claim 16, wherein said interior surface is generally parallel to said surface of said cover plate.

23. A golf club head comprising:

(a) a body having an interior space, said body comprising an opening communicating with said interior space and defined by a periphery and means on said periphery for positioning said cover plate relative to said body;

(b) a cover plate for attachment to said body, said cover plate having a surface forming a golf ball striking surface;

(c) means for securing said cover plate to said body, comprising a quantity of material within at least a portion of said interior space; and (d) an interior surface positioned within said interior space, spaced from said cover plate, wherein said quantity of material is positioned between said interior surface and said cover plate.

24. The golf club head of claim 23, wherein said interior surface is generally parallel to said surface of said cover plate.

25. A golf club head comprising:

(a) a body having an interior space;

(b) a cover plate for attachment to said body, said cover plate being a separate member from said body and having a surface forming a golf ball striking surface; and (c) means for securing said cover plate to said body, comprising a quantity of filler material within at least a portion of said interior space for pressing said cover plate against said body;

wherein said body comprises an opening defined by a first periphery, said first periphery comprising a first tapered surface facing said interior space, wherein said cover plate comprises a second periphery, said second periphery comprising a second tapered surface which mates with said first tapered surface when said cover plate is secured to said body, and wherein said quantity of filler material further comprises means for pressing said second tapered surface of said cover plate against said first tapered surface of said body.

* * * * *